US005564526A

United States Patent [19]

Barnard

[11] Patent Number: 5,564,526

[45] Date of Patent: Oct. 15, 1996

[54] MAGNETIC DRAIN PLUG

[76] Inventor: Charles E. Barnard, 400 Willis St., Daingerfield, Tex. 75638

[21] Appl. No.: 517,730

[22] Filed: Aug. 21, 1995

[51] Int. Cl.[6] ..... F01M 1/10

[52] U.S. Cl. ..... 184/6.25; 210/222; 335/305

[58] Field of Search ..... 184/6.25; 210/222; 335/305, 306

[56] References Cited

U.S. PATENT DOCUMENTS

| | | | |
|---|---|---|---|
| 4,851,116 | 7/1989 | Tomita | 184/6.25 |
| 5,314,625 | 5/1994 | Farnelli | 184/6.25 |
| 5,465,078 | 11/1995 | Jones, Jr. | 184/6.25 |

FOREIGN PATENT DOCUMENTS

| | | | |
|---|---|---|---|
| 0733388 | 7/1955 | United Kingdom | 210/222 |

*Primary Examiner*—F. Daniel Lopez
*Assistant Examiner*—Christopher Verdier

[57] ABSTRACT

A drain plug has an interior cylindrical component with exterior screw threads adapted to be threadedly secured with respect to a threaded aperture in a crank case. The drain plug also has an enlarged exterior head with an external periphery. The drain plug is fabricated of steel. An attachment is positionable over the periphery of the head. The attachment is of a length essentially equal to the length of the head of the drain plug. The attachment has an internal periphery of a configuration adapted to be slidably received over the periphery of the drain plug. The attachment has an external periphery in a configuration. The attachment is fabricated of a permanently magnetized material with a north pole adjacent one end and a south pole adjacent the opposite end whereby the magnetized nature of the attachment will magnetize the head of the drain plug as well as its cylindrical component to attract metal particles.

3 Claims, 2 Drawing Sheets

MAGNETIC DRAIN PLUG

BACKGROUND OF THE INVENTION

1. Field of the Invention

The present invention relates to a magnetic drain plug and associated attachment and, more particularly, pertains to utilizing magnetic fields to preclude damage which would otherwise be caused by magnetic particles suspended within the oil of a crankcase for an internal combustion engine.

2. Description of the Prior Art

The use of plugs for crank cases and other devices of a wide variety of designs and configurations is known in the prior art. More specifically, plugs for crank cases and other devices of a wide variety of designs and configurations heretofore devised and utilized for the purpose of removing harmful particles from oil lubricating an internal combustion engine by various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,869,391 to Kramer a magnetic drain plug assembly with a plug including a magnet on one end thereof for detecting metal chips in the lubrication sump of an engine.

U.S. Pat. No. 4,839,044 to Tomita discloses a magnet filter in which a permanent magnet piece is wrapped up by a magnetically permeable plate except for at least one magnetic pole surface.

U.S. Pat. No. 4,857,188 to Aisa et al. discloses an iron powder attracting magnet wherein a plurality of spaces are formed to open to an iron powder attracting surface.

U.S. Pat. No. 4,894,153 to Shirdavani discloses a magnetic attachment for a filter in which a plurality of magnets are detachably attached to the exterior of the cylindrical casing of a liquid filter unit.

Lastly, U.S. Pat. No. 5,196,112 to Eichman discloses an oil drain apparatus which is directed into an oil filter boss in an operative association with a valve to permit selective flow of oil from the valve directed from the oil filter boss.

In this respect, the magnetic drain plug and associated attachment system according to the present invention substantially departs from the conventional concepts and designs of the prior art, and in so doing provides an apparatus primarily developed for the purpose of utilizing magnetic fields to preclude damage which would otherwise be caused by magnetic particles suspended within the oil of a crankcase for an internal combustion engine.

Therefore, it can be appreciated that there exists a continuing need for a new and improved magnetic drain plug and associated attachment system which can be used for utilizing magnetic fields to preclude damage which would otherwise be caused by magnetic particles suspended within the oil of a crankcase for an internal combustion engine. In this regard, the present invention substantially fulfills this need.

SUMMARY OF THE INVENTION

In view of the foregoing disadvantages inherent in the known types of plugs for crank cases and other devices of a wide variety of designs and configurations now present in the prior art, the present invention provides an improved magnetic drain plug and associated attachment system. As such, the general purpose of the present invention, which will be described subsequently in greater detail, is to provide a new and improved magnetic drain plug and associated attachment system and method which has all the advantages of the prior art and none of the disadvantages.

To attain this, the present invention essentially comprises a new and improved magnetic drain plug and associated attachment system comprising, in combination, a drain plug having an interior cylindrical component with exterior screw threads adapted to be threadedly secured with respect to a threaded aperture in a crank case, the drain plug also having an enlarged exterior head with a hexagonal external periphery, the head having an interior end and an exterior end and a predetermined axial length between the ends, the drain plug being fabricated of steel; and an attachment positionable over the periphery of the head of the drain plug, the attachment having an interior end and an exterior end and being of an axial length essentially equal to the axial length of the head of the drain plug, the attachment having an internal periphery of a hexagonal configuration and of a size whereby it is adapted to be slidably received over the external periphery of the head of the drain plug, the attachment having an external periphery in a hexagonal configuration adapted to be contacted and rotated by a conventional wrench and socket, the attachment being fabricated of steel permanently magnetized with a north pole adjacent one end and a south pole adjacent the opposite end whereby the magnetized nature of the attachment will magnetize the head of the drain plug as well as its cylindrical component to attract metal particles for purging them from the circulating lubricating oil in the crank case in which it is utilized.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved magnetic drain plug and associated attachment system which has all the advantages of the prior art plugs for crank cases and other devices of a wide variety of designs and configurations and none of the disadvantages.

It is another object of the present invention to provide a new and improved magnetic drain plug and associated attachment system which may be easily and efficiently manufactured and marketed.

It is a further object of the present invention to provide a new and improved magnetic drain plug and associated attachment system which is of a durable and reliable construction.

An even further object of the present invention is to provide a new and improved magnetic drain plug and associated attachment system which is susceptible of a low cost of manufacture with regard to both materials and labor, and which accordingly is then susceptible of low prices of sale to the consuming public, thereby making such plugs for crank cases and other devices of a wide variety of designs and configurations economically available to the buying public.

Still yet another object of the present invention is to provide a new and improved magnetic drain plug and associated attachment system which provides in the apparatuses and methods of the prior art some of the advantages thereof, while simultaneously overcoming some of the disadvantages normally associated therewith.

Even still another object of the present invention is to utilize magnetic fields to preclude damage which would otherwise be caused by magnetic particles suspended within the oil of a crankcase for an internal combustion engine.

Lastly, it is an object of the present invention to provide a drain plug and associated attachment. A drain plug has an interior cylindrical component with exterior screw threads adapted to be threadedly secured with respect to a threaded aperture in a crank case. The drain plug also has an enlarged exterior head with an external periphery. The drain plug is fabricated of steel. An attachment is positionable over the periphery of the head. The attachment is of a length essentially equal to the length of the head of the drain plug. The attachment has an internal periphery of a configuration adapted to be slidably received over the periphery of the drain plug. The attachment has an external periphery in a configuration. The attachment is fabricated of a permanently magnetized material with a north pole adjacent one end and a south pole adjacent the opposite end whereby the magnetized nature of the attachment will magnetize the head of the drain plug as well as its cylindrical component to attract metal particles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
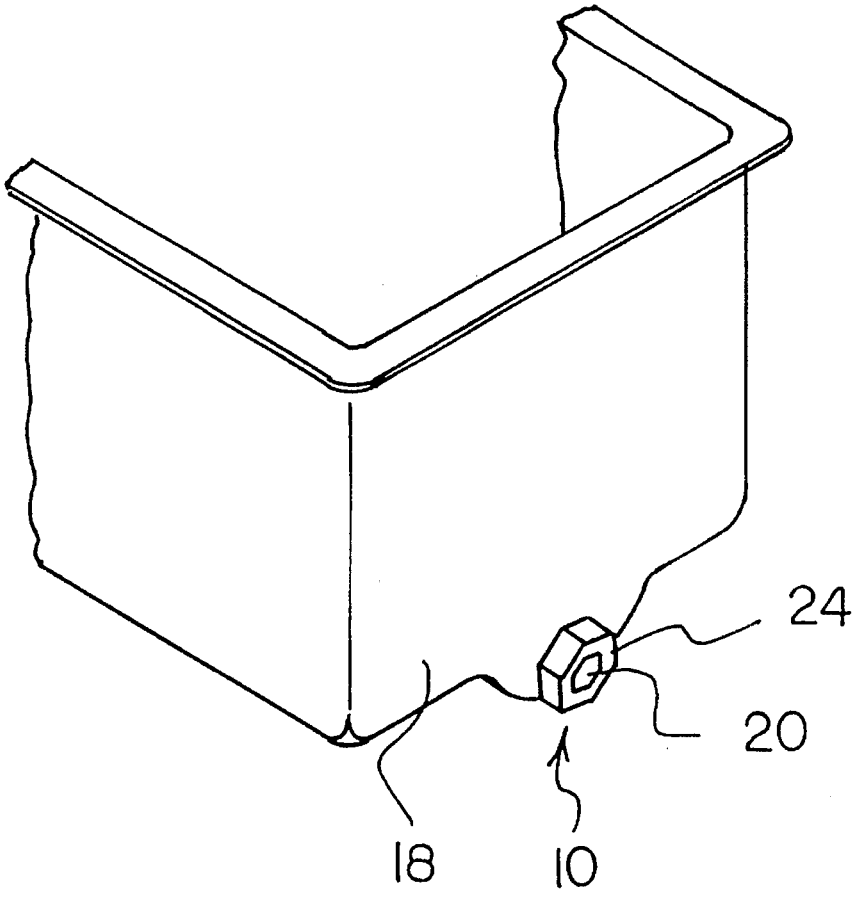
FIG. 1 is a perspective illustration of the preferred embodiment of the new and improved magnetic drain plug and associated attachment system constructed in accordance with the principles of the present invention.
Figure 2:
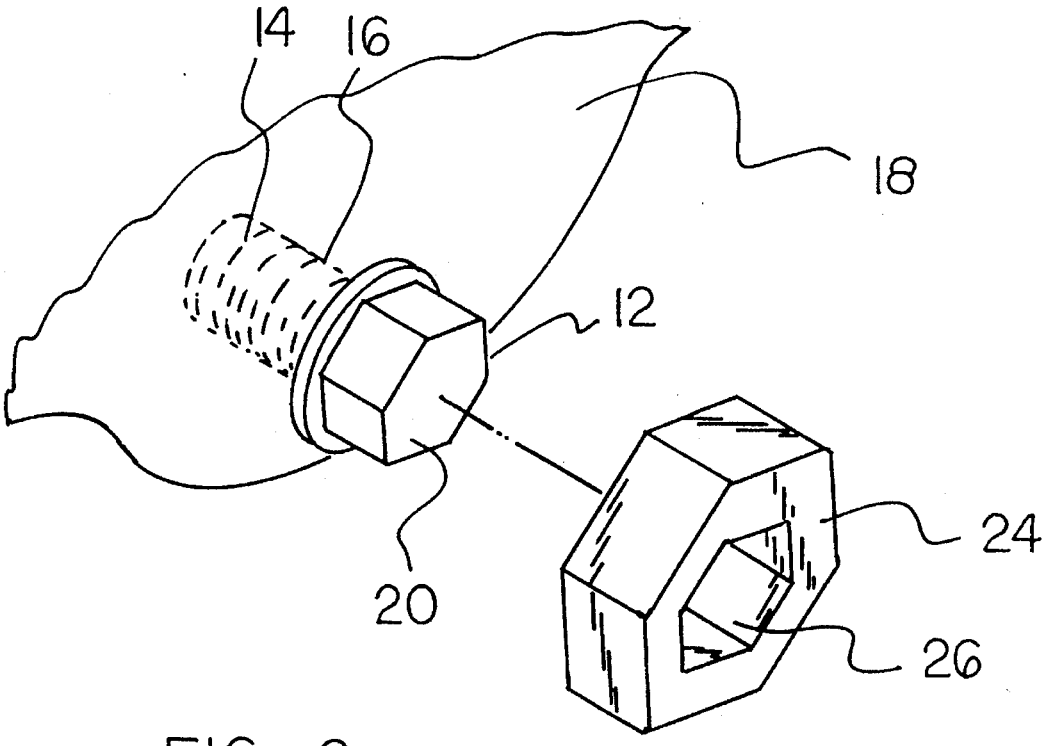
FIG. 2 is an enlarged perspective view of the apparatus shown in FIG. 1.
Figure 3:
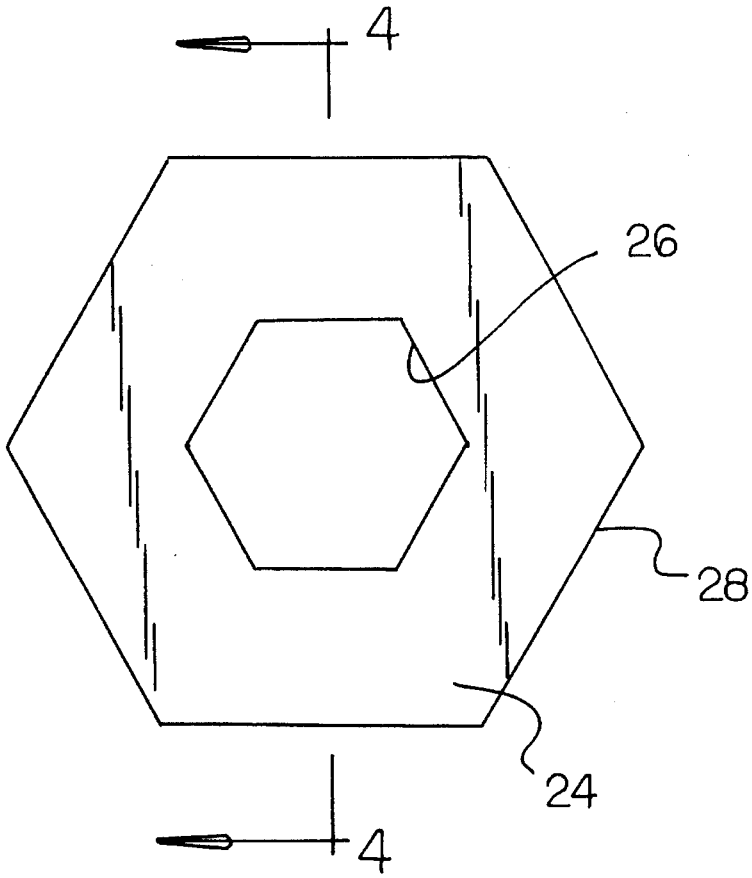
FIG. 3 is a front elevational view of the device shown in FIGS. 1 and 2.
Figure 4:
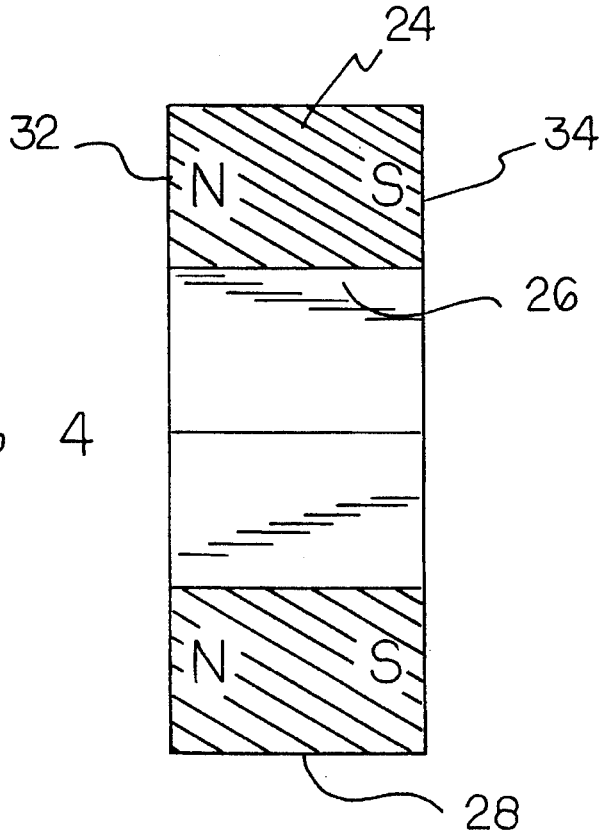
FIG. 4 is a cross-sectional view taken along line 4—4 of FIG. 3.

With reference now to the drawings, and in particular to FIG. 1 thereof, the preferred embodiment of the new and improved drain plug and associated attachment embodying the principles and concepts of the present invention and generally designated by the reference numeral 10 will be described.

The present invention, the new and improved magnetic drain plug and associated attachment, is a system 10 comprised of a plurality of components. In their broadest context, the components include a drain plug and a magnetic attachment. Each of the individual components is specifically configured and correlated one with respect to the other so as to attain the desired objectives.

More specifically, the present invention is in a drain plug and attachment system 10. The drain plug 12 is formed to have an interior cylindrical component 14 with exterior screw threads 16. Such screw threads are adapted to be threadedly secured with respect to a threaded aperture in a crank case 18. The drain plug is also formed to have an enlarged exterior head 20. Such head has a hexagonal external periphery. The head is also formed with an interior end and an exterior end. Such head also has a predetermined axial length between the ends. In the preferred embodiment, the drain plug is preferably fabricated of steel, preferably a high carbon steel for extended life.

The second component of the system 10 is an attachment 24. The attachment has an interior end and an exterior end. Such attachment is positionable over the external periphery of the head of the drain plug. Note FIG. 1. The attachment has an interior end and an exterior end. It is of an axial length essentially equal to the axial length of the head of the drain plug.

The attachment has an internal periphery 26. Such internal periphery is of a hexagonal configuration. It is of a size adapted to be slidably received over the external periphery of the head of the drain plug.

The attachment is also formed to have an external periphery 28. Such external periphery is of a hexagonal configuration. It is of a size and shape to be contacted and rotated by a conventional wrench and/or socket.

The attachment is fabricated of steel and is preferably permanently magnetized with a north pole 32 adjacent one end and a south pole 34 adjacent the opposite end. In this manner, the magnetic nature of the attachment will magnetize the head of the drain plug as well as its cylindrical component. This will function to attract metal particles within the oil of the drain pan for purging such particles, when magnetically responsive, from the circulating lubricating oil in the crank case in which it is utilized.

The present invention comprises an attachment for an internal combustion engine crankcase drain plug which will attract metallic particles, thereby purging them from the circulating lubricating oil. It is made of steel which has been permanently magnetized, and it is formed to slip over the original drain plug. That is, two hexagonal contours are formed on the attachment. The first is an internal hexagon, much like that used on an Allen head screw, and it extends axially through the entire length of the attachment. The second is a standard external hexagon sized to fit any conventional wrench or socket.

From the foregoing description, the use of this novel and functional attachment becomes fairly obvious. It is simply slipped over the original drain plug just before it is reinstalled, and a larger wrench is used to engage the attachment which, in turn, drives the plug. With the magnet in place, impurities such as sludge and dirt containing metallic particles will be attracted and collected on the plug; hence, they will not circulate through the lubricating circuit to cause damage to the moving parts of the engine. When the oil is changed, it is a simple matter to clean the plug and attachment before reinstallation.

The idea of the present invention is simple but very effective. Metallic particles will normally remain in suspension and, as carried by pressurized oil, act as an abrasive. The present invention addresses and eliminates that problem.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A magnetic drain plug and associated attachment system comprising, in combination:

a drain plug having an interior cylindrical component with exterior screw threads adapted to be threadedly secured with respect to a threaded aperture in a crank case, the crank case including circulating lubricating oil, the drain plug also having an enlarged exterior head with a hexagonal external periphery, the head having an interior end and an exterior end and a predetermined axial length between the ends, the drain plug being fabricated of steel; and an attachment positionable over the periphery of the head of the drain plug, the attachment having an interior end and an exterior end and being of an axial length essentially equal to the axial length of the head of the drain plug, the attachment having an internal periphery of hexagonal configuration and of a size whereby it is adapted to be slidably received over the external periphery of the head of the drain plug, the attachment having an external periphery in a hexagonal configuration adapted to be contacted and rotated by a wrench and socket, the attachment being fabricated of steel permanently magnetized with a north pole adjacent to one end and a south pole adjacent to the opposite end whereby the magnetized nature of the attachment will magnetize the head of the drain plug as well as its cylindrical component to attract metal particles for purging them from the circulating lubricating oil in the crank case in which it is utilized.

2. A magnetic drain plug and associated attachment system comprising:

a drain plug having an interior cylindrical component with exterior screw threads adapted to be threadedly secured with respect to a threaded aperture in a crank case, the drain plug also having an enlarged exterior head with an external periphery, the drain plug being fabricated of steel; and an attachment positionable over the periphery of the head, the attachment being of a length essentially equal to the length of the head of the drain plug, the attachment having an internal periphery of a configuration adapted to be slidably received over the periphery of the drain plug, the attachment having an external periphery, the attachment being fabricated of a permanently magnetized steel with a north pole adjacent to one end and a south pole adjacent the opposite end whereby the magnetized nature of the attachment will magnetize the head of the drain plug as well as its cylindrical component to attract metal particles.

3. A magnetic drain plug and associated attachment system comprising:

a drain plug having an interior cylindrical component with exterior screw threads adapted to be threadedly secured with respect to a threaded aperture in a crank case the drain plug also having an enlarged exterior head with an external periphery, the drain plug being fabricated of steel; and an attachment positionable over the periphery of the head, the attachment being of a length essentially equal to the length of the head of the drain plug, the attachment having an internal periphery of a configuration adapted to be slidably received over the periphery of the drain plug, the attachment having an external periphery in a hexagonal configuration, the attachment being fabricated of a permanently magnetized material with a north pole adjacent to one end and a south pole adjacent the opposite end whereby the magnetized nature of the attachment will magnetize the head of the drain plug as well as its cylindrical component to attract metal particles.

* * * * *